US005143005A

United States Patent [19]

Jimenez et al.

[11] Patent Number: 5,143,005

[45] Date of Patent: Sep. 1, 1992

[54] CONTRIVANCE FOR PASSING A GRASPING DEVICE FOR A THREAD INTO THE EYE OF A SEWING NEEDLE, AND APPLICATION OF THIS CONTRIVANCE

[75] Inventors: Antonio Jimenez, Meyrin; Yves Combepine, Bernex both of Switzerland; Patrice Déeplante, Annemasse, France

[73] Assignee: Mefina S.A., Switzerland

[21] Appl. No.: 695,227

[22] Filed: May 3, 1991

[30] Foreign Application Priority Data

May 3, 1990 [CH] Switzerland ..... 1505/90

[51] Int. Cl.[5] ..... D05B 87/02

[52] U.S. Cl. ..... 112/225

[58] Field of Search ..... 112/224, 225, 302

[56] References Cited

U.S. PATENT DOCUMENTS

| | | | |
|---|---|---|---|
| 2,655,886 | 10/1953 | Ingwer | 112/225 |
| 2,704,526 | 3/1955 | Benink et al. | 112/225 |
| 2,707,448 | 5/1955 | Naas . | |
| 2,767,671 | 10/1956 | Shapiro | 112/225 |
| 3,485,194 | 12/1969 | Eguchi | 112/225 |
| 3,502,045 | 3/1970 | Hanyu | 112/225 |

FOREIGN PATENT DOCUMENTS

| | | | |
|---|---|---|---|
| 377503 | 9/1907 | France | 112/225 |
| 1065661 | 5/1954 | France . | |
| 364683 | 11/1962 | Switzerland . | |
| 1057591 | 11/1983 | U.S.S.R. | 112/225 |
| 1184085 | 3/1970 | United Kingdom . | |

*Primary Examiner*—Werner H. Shroeder
*Assistant Examiner*—Paul C. Lewis
*Attorney, Agent, or Firm*—Cushman, Darby & Cushman

[57] ABSTRACT

This contrivance includes a support (1), in which a tubular element (5) is mounted to slide, the tubular element containing a rod (6) mounted to slide in it and subjected to the action of a restoring spring (7) fixed to the support (1). At its lower end, the element (5) has two shells (10, 11) forming a cage (9) in cooperation with a belt (13) that is solid with the rod (6) and is moreover connected to the shell (11) by a second restoring spring (15). An element (17) is mounted to slide horizontally in the shell (10) and carries a hook (18) for grasping the thread, the movement of which hook is controlled by the joint action of a slideway (19), solid with the belt (13), and a dog point (17*a*) solid with the element (17). Any relative displacement of the shells (10 and 11) and of the belt (13) leads to an axial movement of the element (17) along a path such that the hook (18) is made to pass through the eye (c) of the needle (4) to grasp any thread placed on a support (22) solid with the element (17) affixed to the shells (10 and 11) of the cage (9). This contrivance may be used for threading the eye of a needle of a sewing machine in particular.

28 Claims, 9 Drawing Sheets

FIG. 3
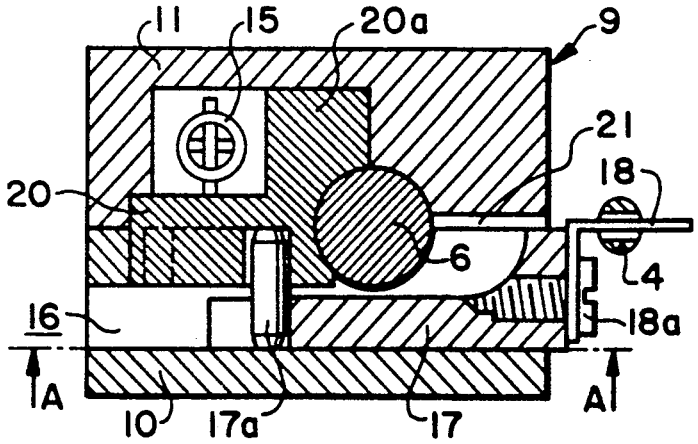
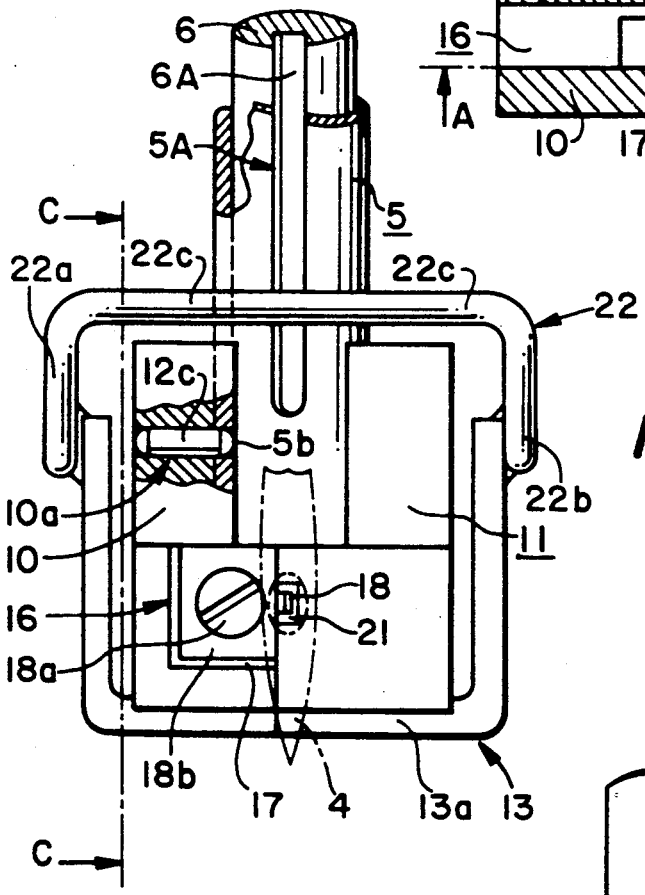
FIG. 4
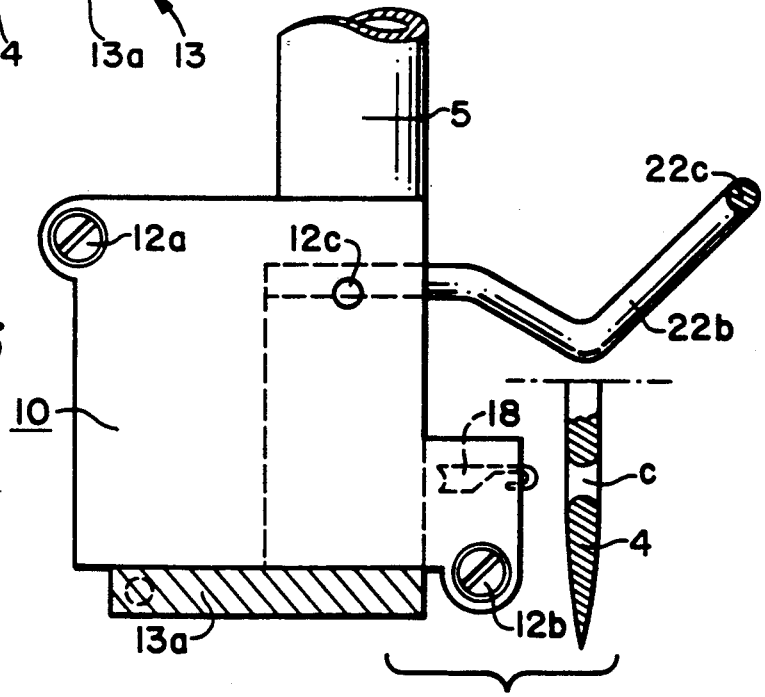
FIG. 5

CONTRIVANCE FOR PASSING A GRASPING DEVICE FOR A THREAD INTO THE EYE OF A SEWING NEEDLE, AND APPLICATION OF THIS CONTRIVANCE

FIELD OF THE INVENTION

The present invention relates to a contrivance for passing a grasping device for a thread into the eye of a sewing needle fixed to a support apparatus, and to an application of such a contrivance.

BACKGROUND OF THE INVENTION

The invention seeks to offer the user a means that is easy simple to use and achieves reliable results, to enable the user to pass a thread into the eye of a sewing needle, which may be either a needle for hand sewing or a sewing machine needle, for straight or zig-zag stitching for instance, or even a needle of an embroidery machine.

Innumerable means for this use have already been proposed, from the simplest, such as a flexible metal loop that engages the eye of a needle and into the opening of which the thread to be threaded is passed and then pulled through the eye, removing the loop from it, to the most complicated, in particular including injectors and pneumatic suction devices that in the first case enable propelling the thread through the eye with jets of compressed air and in the second case aspirating such a thread through the eye. U.S. Pat. No. 4,381,021 shows a contrivance of this type.

Other constructions, such as those disclosed in U.S. Pat. Nos. 2,707,448; 2,910,029; and 4,651,660, or British Patent 1,184,085, for example, intended more particularly for sewing machines, make use of the most various mechanical means, in particular employing a hook intended to instantaneously extend through the eye of the needle to grasp a thread and thread it into it by displacement of the hook in a direction opposite the direction in which it passed into the eye.

Even though they have an often complicated structure, these constructions all have the same defect: None of them enable the user to "feel" whether the hook is passing freely through the opening of the eye or contrarily, for instance if it is slightly creased inadvertently or if the needle has been deformed or poorly positioned in its support apparatus, it may abut against the body of the needle and threaten to further deteriorate it, or even break it, if the threading procedure continues.

Moreover, contrivances of sufficiently simple and reliable function and structure that can be used with certainty even by persons who are visually handicapped and/or are handicapped in their motor abilities are not yet known at present. This is equally true for threading needles for hand sewing and for sewing machine needles.

SUMMARY OF THE INVENTION

The contrivance the characteristics of which are recited in claim 1 and the claims that follow makes it specifically possible to overcome the disadvantages of similar contrivances already available on the market.

Substantially, but not exclusively, the contrivance according to the invention may be an integral part of a sewing machine, whether of the industrial type or for household use.

An exemplary embodiment and a variant of the contrivance according to the invention, and two applications of this contrivance, are described in detail below and shown by way of non-limiting example in the accompanying drawings.

BRIEF DESCRIPTION OF THE DRAWINGS

FIG. 3 is a section taken along the lines III—III of FIG. 2C;

FIG. 4 is a view of detail B of FIG. 2B;

FIG. 5 is an elevation view of a detail C, with partial shading of the assembly shown in FIG. 4;

DESCRIPTION OF THE PREFERRED EMBODIMENTS

Figure 1A:
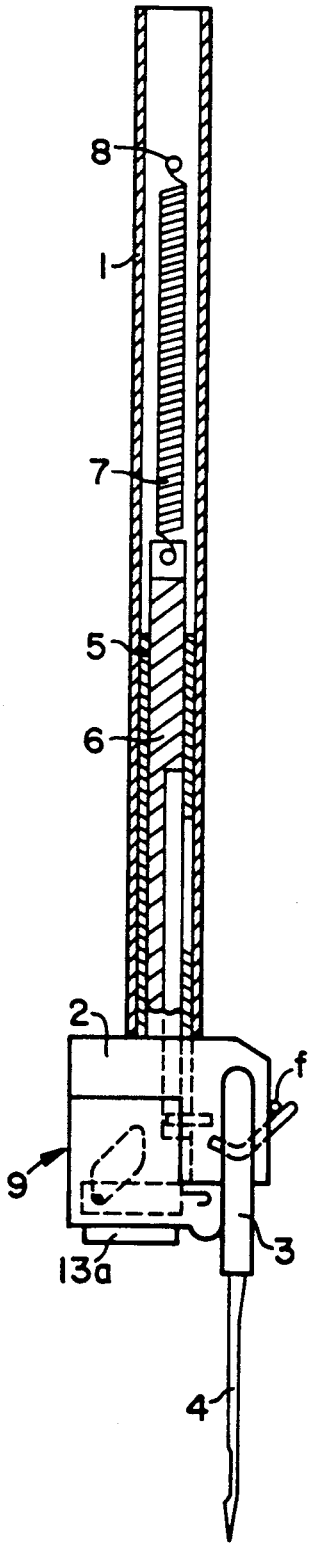
FIGS. 1A–1E are views in lateral elevation and fragmentary vertical section of the contrivance, in five successive working positions.

The contrivance shown in the drawings is intended more particularly to enable passing a thread into the eye of a sewing machine needle. However, it is understood that with appropriate modification, the parts that constitute it may be integrated into a contrivance for more general usage, for instance one for threading the eye of everyday needles.

The entire contrivance is fixed on a tubular support 1, which in this case constitutes the needle bar of a sewing machine, for straight and/or zig-zag sewing, for example.

At its lower end, this needle bar has a head 2 to which a support device 3 for a needle 4 is to be movably fixed. The functional assembly including these elements has been the subject of an earlier patent application filed by the present applicant (Swiss Application 3743/89-8), which should be referred to for further detail.

Figure 2A:
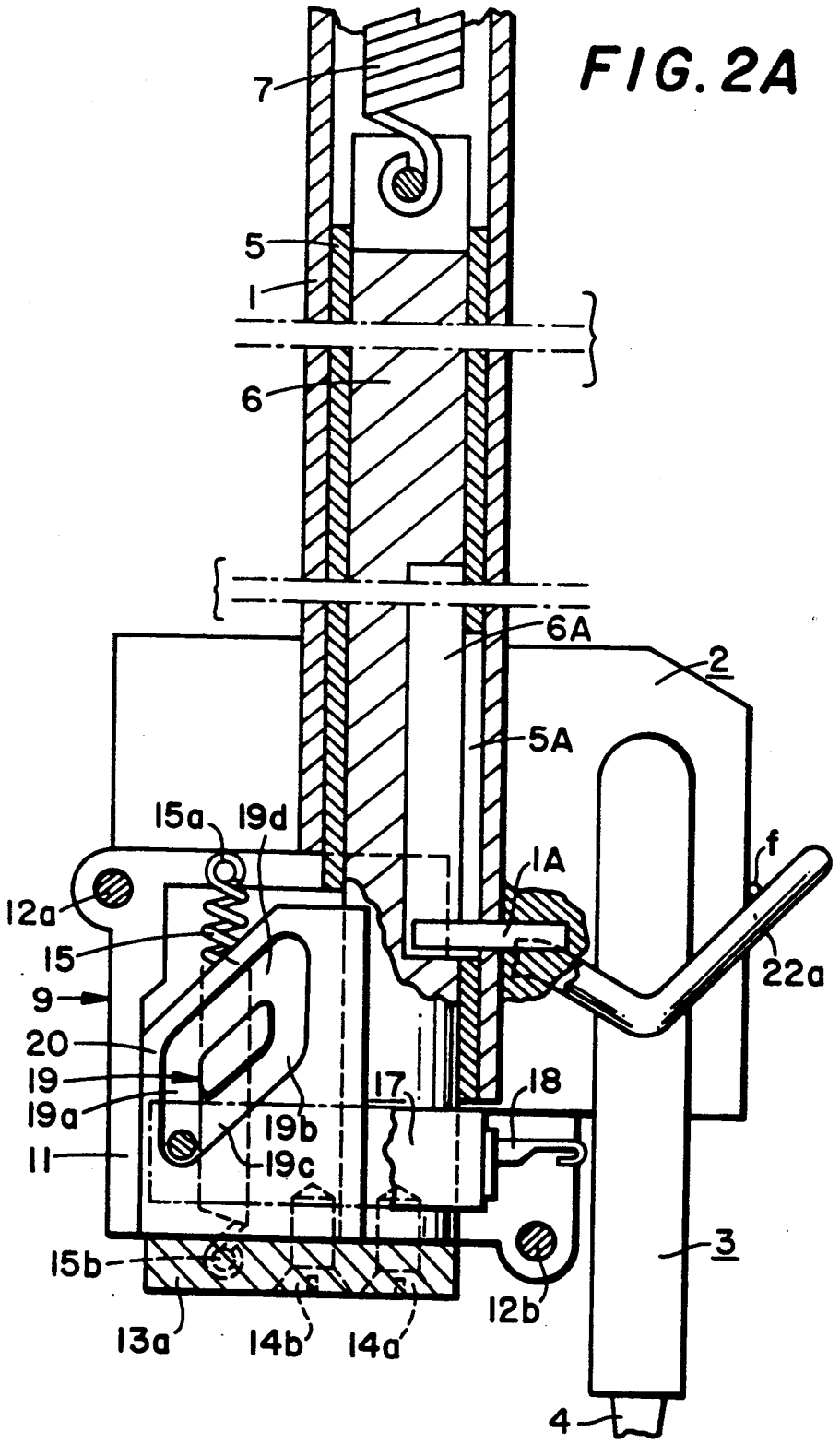
FIGS. 2A and 2B are views in fragmentary vertical section, on a larger scale, of the lower portion of FIGS. 1A and 1B, respectively.

A tubular element 5 is mounted slidingly inside the support and a rod 6 is disposed in the tubular element, also slidingly, and connected by its upper end to a spring 7 that in turn is fixed at 8 to the support 1 (see FIGS. 1A and 2A).

The tubular element 5 has a longitudinal slot 5A that opens vertically of a groove 6A of the rod 6 and through which a pin 1A that is solid with the lower portion of the head and the support 1 and also engages this groove 6A.

As can be seen more directly in FIGS. 2C and 3, the support 1, the tubular element 5 and the rod 6 pass all the way through the head 2: the first and second of these elements accordingly emerge below this head.

Figure 2B:
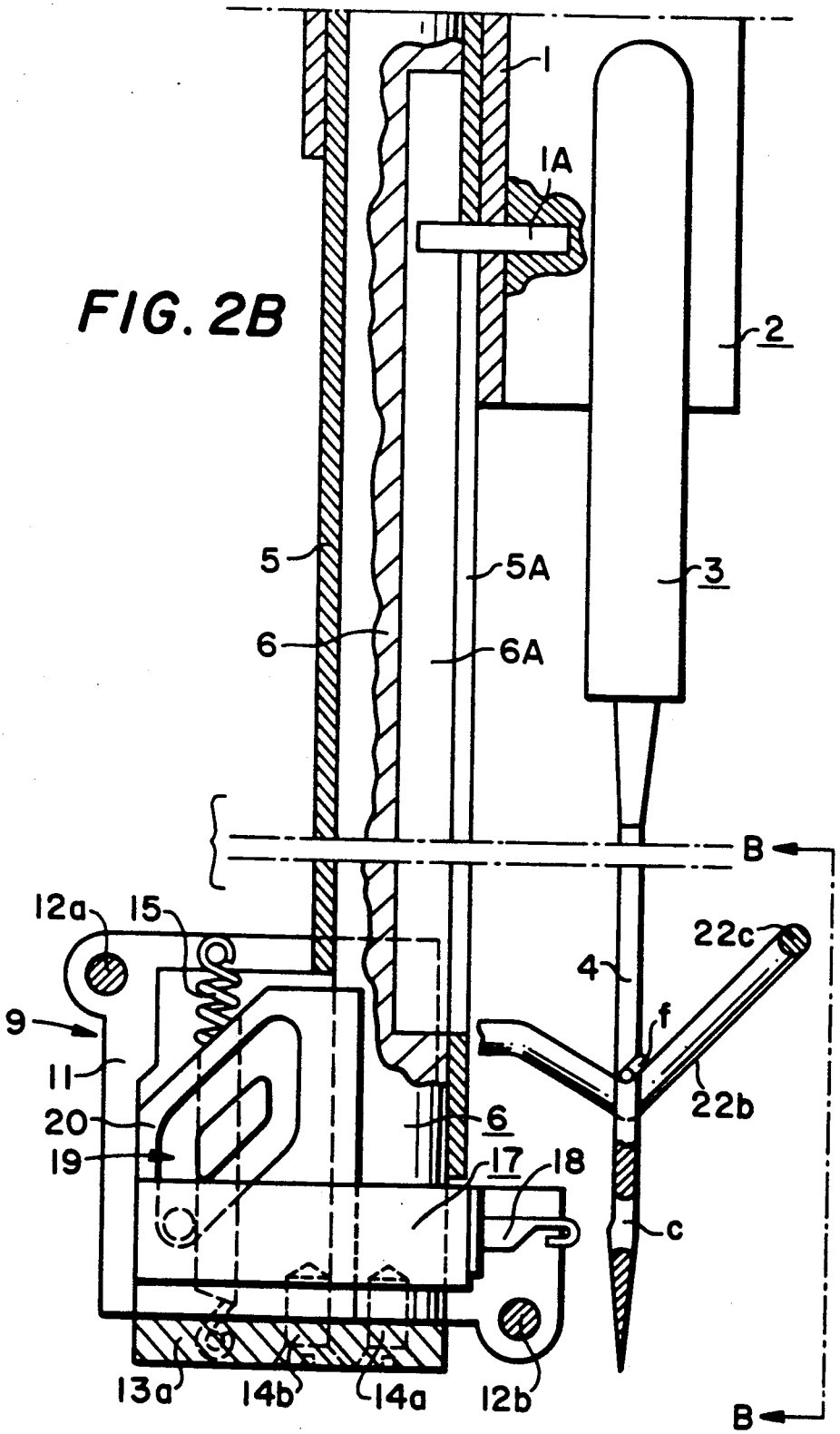
Figure 2C:
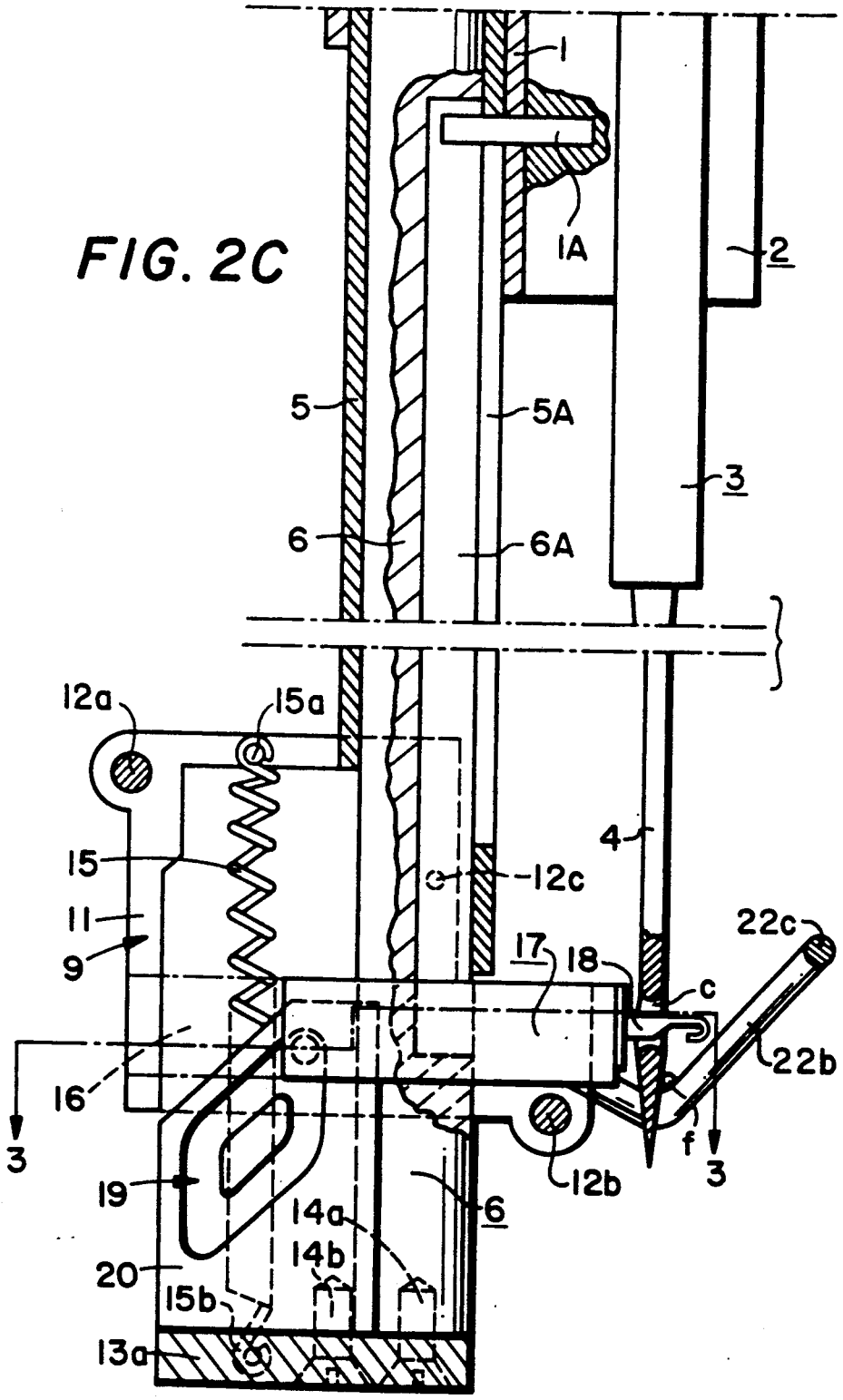
FIG. 2C is a view of the detail A of FIG. 3, corresponding to the lower portion of FIG. 1C and showing various elements illustrated in FIGS. 2A and 2B, in a different functional position of the contrivance.

In its lower portion, the contrivance shown has a cage 9 formed on the one hand by two shells 10 and 11 assembled with screws 12*a* and 12*b* (FIGS. 3-5), the shells being made solid with the tubular element 5 by a pin 12*c* engaging a passage 10*a* of the shell 10, as well as an opening 5*b* passing through the wall of this element and on the other hand, via a bottom 13*a* of a belt 13 in the form of a U, the utility of which will become apparent hereinafter and which is made solid with the rod 6 by a screw 14*a* (FIGS. 2A-2C). This belt 13 is moreover attached to the shell 11 of the cage 9 by a spring 15 fixed in a slightly extended position respective to the shell at 15*a* and to the belt at 15*b*, respectively.

It should be noted that this spring is such that the force necessary to displace the belt 13 downward in the drawing, that is, to separate this belt from the rest of the cage 9, for example to move it from the position seen in FIG. 2A to that shown in FIG. 2C, is greater than that necessary to drive the rod 6 downward in the drawing, counter to the action of the spring 7.

It follows that although there is nothing to oppose the sliding of the tubular element 5 in the support 1, any vertical traction, downward in the drawing, exerted on the belt 13 translates into a corresponding displacement of the entire cage 9, this belt driving the set of shells 10 and 11, via the spring 15, and axial displacement of the rod 6 and element 5 inside the support 1.

Once the upper edge of the slot 5A of the element 5 meets the pin 1A, sliding of this element in the support 1 is interrupted, immobilizing the two shells 10 and 11 of the cage 9, while the belt 13 and the rod 6 with which it is solidly connected are capable of continuing their course, by sliding of this rod 6 within the tubular element 5, counter to the joint action of the spring 7 and the spring 15 (FIG. 2C), the latter stretching increasingly in proportion with the increasing distance between the belt 13 and the set of shells 10 and 11. It will be seen hereinafter that the belt 13 cannot be moved any farther than the lower position seen in FIGS. 1C and 2C of the drawing.

As can be seen more particularly in FIGS. 2C, 3 and 4, the shell 10 of the cage 9 is hollowed out with a traverse passage 16 of substantially rectangular cross section, which extends perpendicular to the element 5 and forms a slideway for a slide 17, to which a small plate 18*b* carrying a grasping hook 18 is affixed by means of a screw 18*a*.

This slide 17 has a pin 17*a*, mounted near its left-hand end as seen in the drawing, which engages a slideway 19 of closed profile, which is hollowed out in a small vertical plate 20 that is affixed to the portion 13*a* of the belt 13 (FIG. 2A) with a screw 14*b*, in the zone 20*a* of the vertical plate (FIG. 3).

As can be seen in the drawing, the slideway 19 comprises a groove forming a cam that defines a closed circuit for the pin 17*a* in the form of a parallelogram, of which two sides, 19*a* and 19*b*, are substantially parallel to the longitudinal axis of the aforementioned elements 1, 5 and 6, with the lower end of the side 19*a* being closer to the part 13*a* of the belt 13, in the drawing, than the corresponding end of the side 19*b* of the slideway 19. The width of the latter is slightly greater than the diameter of the pin 17*a*, which allows a certain axial sway of the slide 17, regardless of how much of the slideway 19 is engaged by this pin.

The position of the slideway 19 in the cage 9 is such that as long as the spring 15 is in a state corresponding to that shown in FIGS. 2A and 2B, that is, as long as the belt 13 and the two shells 10 and 11 are connected (FIGS. 1A and 1B, 2A and 2B), the pin 17*a* is at the lower end of the side 19*a* of the slideway 19, such that the slide 17 occupies the extreme left-hand position of the drawing, and the hook 18 is retracted with respect to the needle 4.

It is suitable at this point to mention that the length of the slot 5A made in the tubular element 5 is selected such that when the cage 9 is moved away from its upper position of repose, corresponding to contact of the cage with the head 2 (FIGS. 1A and 2A), by being lowered counter to the action of the spring 7 in the manner already described, the course of the cage is interrupted by the encounter of the upper edge of the slot 5A with the pin 1A, at a level such that the hook 18 affixed to the slide 17 is located very precisely opposite the eye c of the needle 4 (FIGS. 1B and 2B), and is retracted with respect to it.

If traction continues to be exerted on the belt 13, the belt moves away from the set of shells 10 and 11, because the tubular element with which they are affixed is retained by the pin 1A, and the spring 15 begins to elongate.

It follows that the slideway 19 is displaced vertically downward as seen in the drawing. As long as the pin 17*a* is in engagement with the side 19*a* of the slideway, the slide 17 remains immobile in its first limit position, for retracting the slide and the hook 18 with which it is associated.

When the pin 17*a* enters into contact with the upper edge of the side 19*d* of the slideway 19, the slideway exerts a thrust on this pin that is oriented from left to right in the view of the drawing, such that the pin will be driven toward the right, and with it the slide 17 and the hook 18, until the pin 17*a* comes to be located in the upper right corner of the slideway 19, or in other words practically at the upper end of the second vertical side 19*b* of the slideway. From then on, it becomes impossible to continue to drive the belt 13 downward, and the pin 17*a* thus plays the role of a stop device, in cooperation with the slideway 19.

Figure 1B:
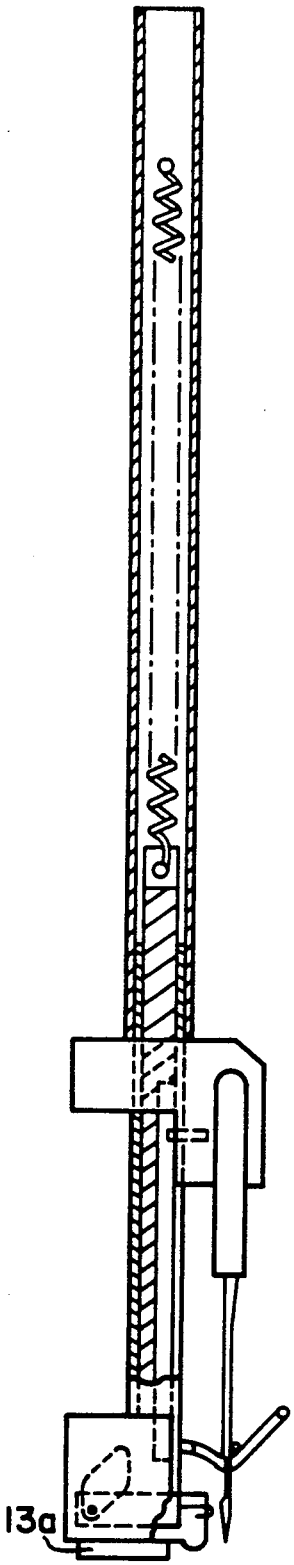
Figure 1C:
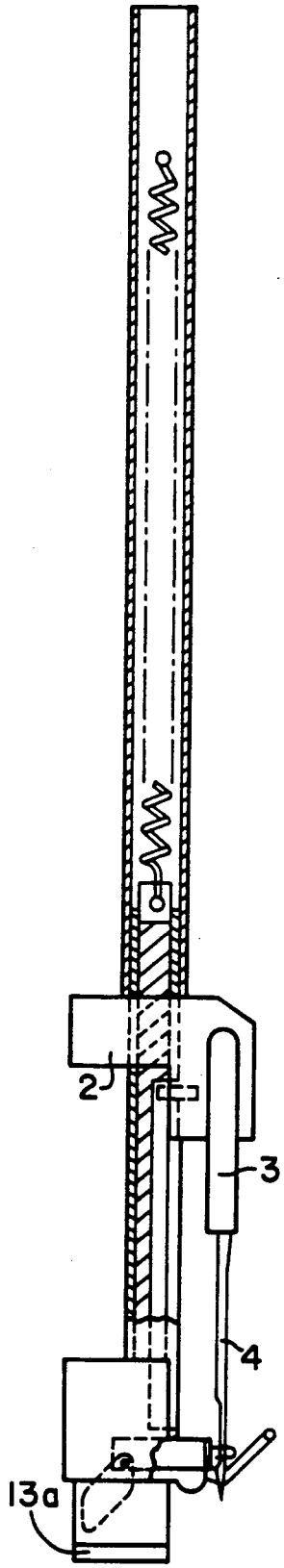

In this position of the elements described, the slide 17 occupies its second, extreme right-hand limit position, in which its curved, functionally active part of the hook 18 has then already passed through the eye c of the needle (FIGS. 1C and 2C).

If the belt 13 of the cage 9 is now left to the action of the spring 15, the pin 17*a* and hence the slide 17 remain immobile, as long as this pin engages the edges of the side 19*b* of the groove 19.

On the other hand, this pin 17*a* and the slide 17 will be driven to the left in the drawing, to resume their initial position, as soon as the pin enters into contact with the lower edge of the side 19*c* of the slideway.

Thus it can be seen that the length of the path of the slide 17 between its two limit positions is substantially equal to the spacing between the longitudinal axes of the vertical sides 19*a* and 19*b* of the slideway 19.

Although in the case shown this distance is identical for each side 19*c* or 19*d*, and the lengths of the vertical sides 19*a* and 19*b* of the slideway 19 are also identical for both sides, it is certainly conceivable in variant embodiments to employ a slideway 19 that is not a parallelogram but instead is a trapezoid, for instance. In that case, the speeds of displacement of the slide 17 would be different, depending on the direction in which it was moving.

In an extreme case, the slideway 19 could even be embodied by a simple slot, inclined with respect to the longitudinal axis of the needle bar, through which the pin 17*a* would move in one direction and then the other in succession.

It is appropriate at this point to mention that in the retracted position of the slide 17 and hence of the hook 18, the hook is entirely accommodated in a groove of rectangular cross section 21, forming a "furrow", hollowed out in the shell 11 of the cage 9 (FIGS. 3 and 4). Thus this hook is fully protected, whenever the contrivance shown is not in use.

As can be seen more particularly in FIGS. 4 and 5, the belt 13 envelops part of the lower face and the two side faces of the set of shelves 10 and 11 that the cage 9 includes. A stirrup 22 formed by two side bars 22*a* and 22*b* and one connecting bar 22*c* is affixed, for instance by welding, to the upper end of the arms of the U of this belt. In profile, the bars 22*a* and 22*b* form a wide-open V.

This stirrup is disposed on the belt 13 substantially at the level of the upper end of the slideway 19, such that the bottom of the opening of the V formed by the bars 22*a* and 22*b* is located slightly below this end of the slideway, substantially half-way up its portion 19*b*. Furthermore, the bottom of the opening of the V of the bars 22*a* and 22*b* is substantially coplanar with the longitudinal axis of the sewing needle 4.

Thus, as will now be illustrated with references to FIGS. 1A–1E and FIGS. 6A–10, in particular, the contrivance described makes it possible to introduce a hook, such as 18, into and easily remove it from the eye of a sewing needle. Because the presence, position and particular conformation of the stirrup 22 also make it possible to proceed such that, upon axial displacement of the hook toward the eye, through it, and then back out again rearward, in the left-hand limit position of the slide 17 (FIG. 2B), the hook 18 can grasp any thread that is placed in an extended position on the bars 22*a* and 22*b* of the stirrup, more precisely in the opening of the V that each of them form, and can be driven from right to left as seen in the drawing in order to thread it into the eye c of the needle.

In FIG. 1A, the contrivance described is represented at rest, with the cage 9 in its highest position, in direct contact with the head 2 to which the support system 3 and the needle 4 are affixed.

Figure 6A:
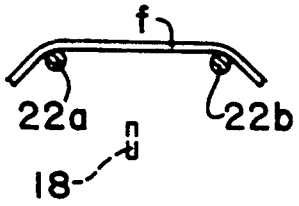
FIGS. 6A, 7A, 8A and 9A are fragmentary schematic views showing the development of the shape of the portion of thread to be threaded into the eye of a needle, in the course of various steps in a threading operation.
Figure 6B:
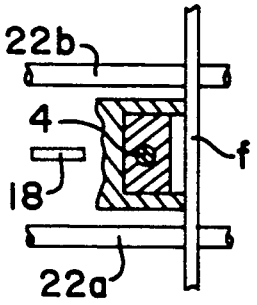
FIGS. 6B, 7B, 8B and 9B are plan views showing how the elements shown in FIG. 6A and 9A look.
Figure 7A:
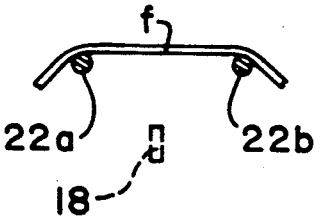
Figure 7B:
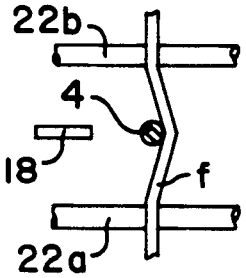
Figure 7C:
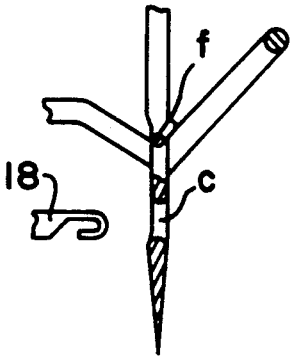
FIGS. 7C, 8C and 9C are enlarged views of a detail of FIGS. 1B, 1C and 1D, respectively.
Figure 8A:
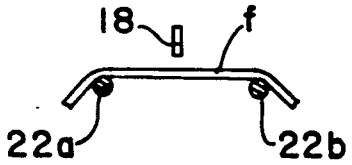

The thread f that is to be threaded into the eye c of the needle is placed on the bars 22*a* and 22*b* (FIG. 6A) and in contact, with the immediate portion of the segment between the bars, with the support system 3 (FIG. 6B). As can be seen in FIGS. 1A, 6A and 6B, this thread segment now extends to a level higher than that of the path of the hook 18.

Next, traction aimed downward in the drawing is exerted simultaneously on both segments of the thread extending on either side of the stirrup 22, so as to cause sliding of the tubular element 5 inside the needle bar 1 counter to the action of the spring 7, and a simultaneous corresponding displacement of the rod 6 and hence of the entire cage 9.

The movement of the tubular element 5 and the set of shells 10 and 11 of the cage 9 associated with it is interrupted as soon as the upper edge of the spot 5A of the element 5 comes into contact with the pin 1A.

At that moment, the various devices of the contrivance described are in the position shown in FIG. 1B. In this drawing figure, and more specifically in the enlargement of FIG. 7C, it can be seen that the thread f is in contact with the needle 4 (FIG. 7B), and that the hook 18 is then at the level of the eye c of the needle. It will be recalled that at that moment the pin 17*a* solidly attached to the slide 17 engages the lower end of the side 19*a* of the slideway 19 (FIG. 2A).

Once the set of shells 10 and 11 of the cage 9 is prevented from being displaced axially, the belt 13 continues its vertical motion, with the rod 6 sliding inside the tubular element 5 counter to the action of the spring 7 as well as of the spring 15.

As long as the pin 17*a* remains in engagement with the side 19*a* of the slideway 19, the slide 17 remains immobile, in its extreme left-hand position corresponding to that of FIG. 2B, for example; contrarily, the stirrup 22 has descended by a height corresponding substantially to the length of the side 19*a* of the slideway 19. As a result, it now occupies an intermediate position, such that the bottom of the V formed by the bars 22*a* and 22*b* is now approximately at the height of the eye c of the needle 4.

The displacement of the slide 17 from left to right, in the direction of the eye of the needle, begins as soon as the pin 17*a* engages the inclined side 19*d* of the slideway 19, and it ends when this pin reaches the right-hand end of the side 19*d*.

During this displacement, the hook 18 passes through the eye c of the needle 4, and the stirrup 22 continues to descend until the point where the bottom of the V formed by the two bars 22*a* and 22*b* are located at a level lower than that of the hook 18, while the hook has not yet completely passed through the eye; as a result, once these displacements of the hook and stirrup are ended, the segment of the thread f resting on the stirrup 22 is then located below the hook 18.

For the hook 18 to be capable of grasping the thread, all that need be done is to relax the vertical traction exerted on it, on either side of the stirrup 22, such that the belt 13 rises again in the direction of the set of shells 10 and 11, by the restoring action developed by the springs 7 and 15.

Figure 9A:
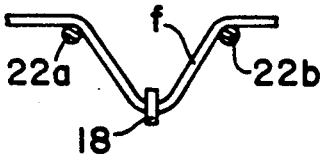
Figure 8B:
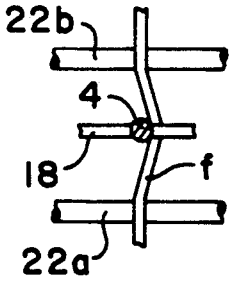
Figure 9B:
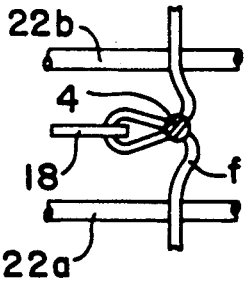
Figure 8C:
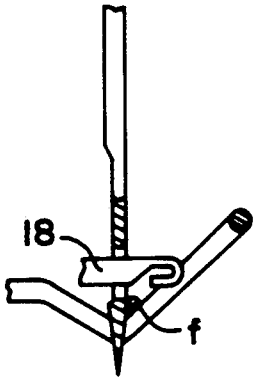

In a first period of time, that is, as long as the pin 17*a* remains in engagement with the vertical side 19*b* of the slideway 19, only the stirrup 22 moves, while the slide 17 remains immobile in its extreme right-hand portion in the drawing; the thread segment f between the bars 22*a* and 22*b* of the stirrup comes into contact with the bottom of the body of the hook 18, by its middle portion, and assumes the shape of a V, as can be seen in FIG. 9A.

Figure 1D:
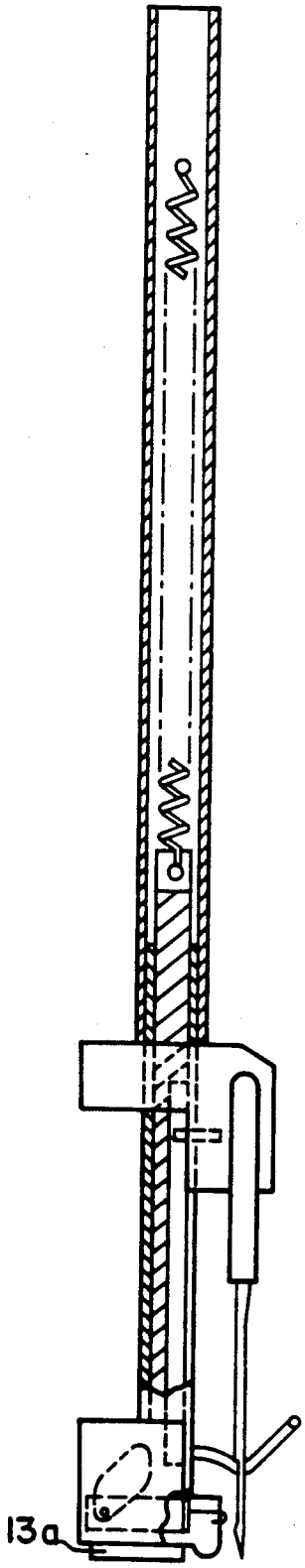
Figure 9C:
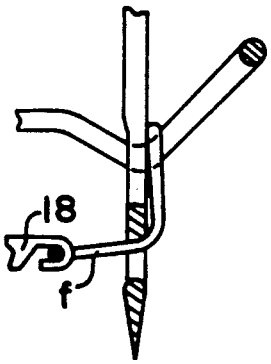

As soon as the pin 17*a* comes to engage the inclined side 19*c* of the slideway 19, the slide 17 begins its leftward movement, retracting the hook 18. The hook then grasps the thread f and drives it through the eye c of the needle 4 (FIGS. 1D and 9C).

The slide 17 reaches its extreme left-hand position when the pin 17*a* is in its initial position (FIG. 1D), that is, as soon as this pin has completed its travel from right to left, as seen in the drawing, into contact with the inclined side 19*c* of the slideway 19.

This accordingly happens once the set of shelves 10 and 11 and the belt 13 are again connected to form the cage 9, that is, as soon as the spring 15 resumes the state of least tension, in which it is shown in FIGS. 2A and 2B in particular.

Beginning at that moment, as the traction exerted on the thread f is relaxed, the set comprising the cage 9, rod 6 and the tubular element 5 returns to its starting position, by the action of the spring 7; that is, the position in which the cage 9 pressed against the head 2 that fixes the needle 4 on the needle bar 1.

Figure 1E:
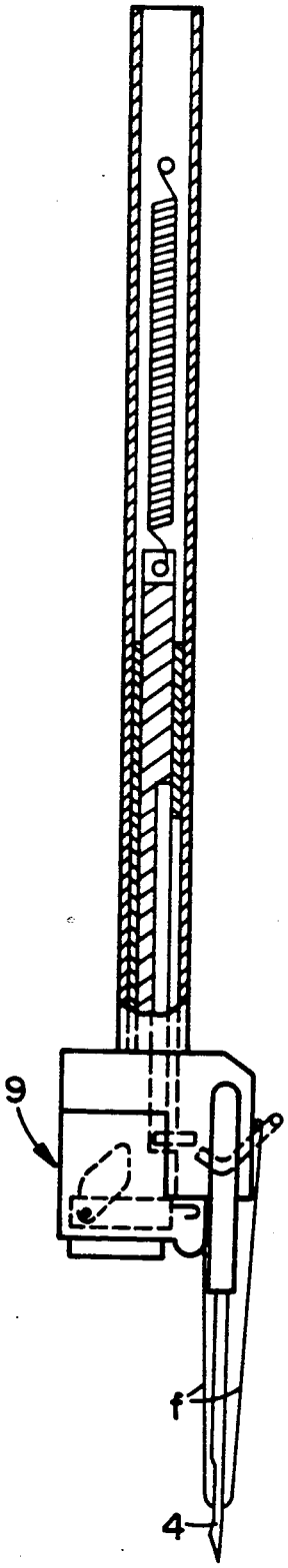
Figure 10:
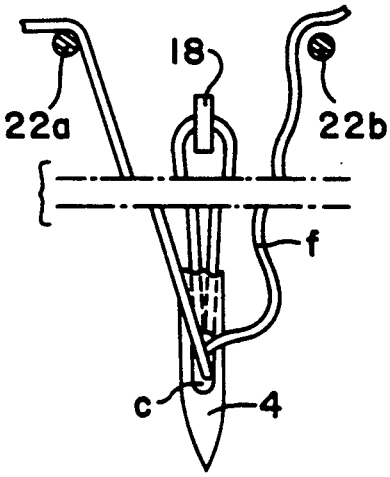
FIG. 10 is a partial view of a detail D of the lower portion of FIG. 1E, shown on a larger scale.

As can be seen clearly in FIGS. 1E and 10, the segment of thread f extending between the bars 22*a* and 22*b* of the stirrup 22 now forms a loop of relatively great length, the end portion of which is retained by the hook 18, extending between the hook and the bars 22*a* and 22*b* and passing via the eye c of the needle 4.

On the assumption that the portion of thread resting on the bar 22*a* of the stirrup 22 is connected directly to a bobbin for supplying thread to the sewing needle 4, and where the portion resting on the bar 22*b* is adjacent to the free end of this thread, it can be seen that it is sufficient for the user to cut the right-hand segment of the loop of thread for example, between the eye c of the needle and the hook 18, for the sewing machine to be ready for operation; the sewing thread has now been threaded, there is a leader of thread beyond the eye the length of which may be increased by pulling on the thread; it is sufficiently long to be grasped by the hook that forms the intended machine sewing stitch.

The contrivance described is thus particularly simple and reliable in function. As a result, it is very easy to use even by visually handicapped persons, for whom threading a needle is a nearly insurmountable problem, or even by the physically handicapped or by elderly persons who suffer from particularly severe trembling.

Furthermore, it will be understood that the effort necessary to employ the contrivance described is transmitted by the thread itself before being threaded into the eye of the needle, if the hook 18 abuts against the needle, especially if the hook and/or the needle have been deformed unduly, and if the user continues to exert traction on the thread, the thread will break before any further deformation of these elements can occur.

Naturally, the invention is not limited to what has been shown and described here.

Figure 13:
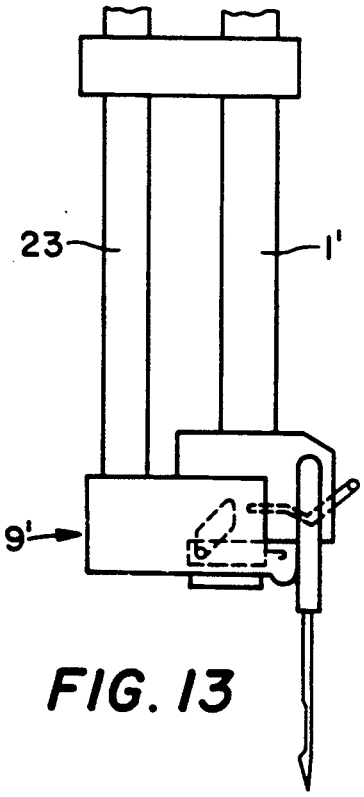
FIG. 13 is a lateral elevation view of a variant of this contrivance.
Figure 14:
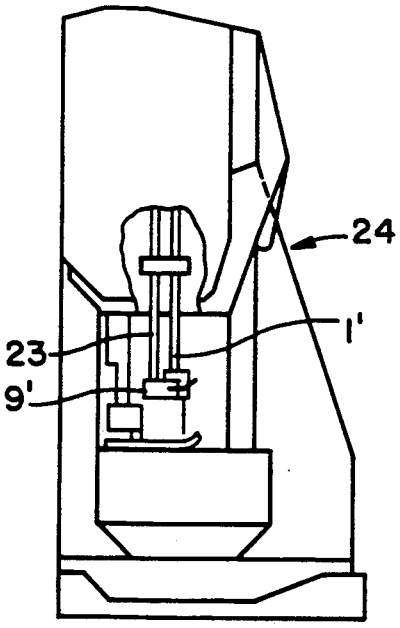
FIG. 14 is a view of this variant similar to FIG. 13, applied to a sewing machine.

Among the possible variant embodiments and applications, the following can be given as examples:

As shown in FIG. 13, the cage 9' of the contrivance can be mounted on a separate tubular support 23, which plays the same role as that of the needle bar 1 in the embodiment of FIGS. 1–10 and is kinematically joined solidly to the needle bar 1'. The telescoping tubular elements 5 and 6, which are not visible in FIG. 13, are then mounted inside the tubular support 23, and the stop 1A is solid with this same tubular support 23. Moreover, the function of the contrivance is identical at all points with that described in conjunction with FIGS. 1–10, which should be referred to here. FIG. 14 illustrates one application of the variant of FIG. 13 to a sewing machine 24.

Figure 12:
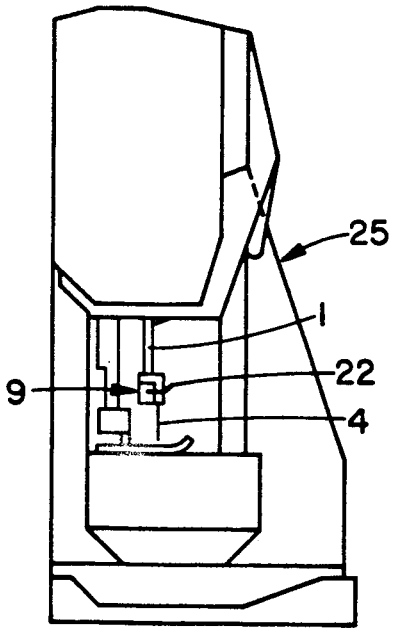
FIG. 12 is a view of the contrivance, similar to FIG. 1A, applied to a sewing machine.

FIG. 12 shows the embodiment of the contrivance shown in FIGS. 1–10 mounted on the needle bar 1 of a sewing machine 25. In this drawing figure, the cage 9 and the portion of the stirrup 22 that projects to the right of this cage, to receive the thread to be threaded into the eye of the needle 4, can be distinguished.

Figure 11:
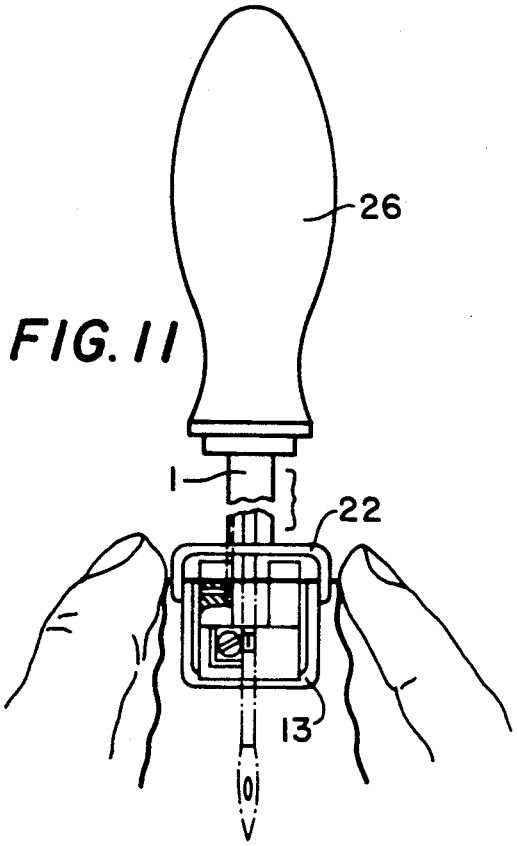
FIG. 11 is a view of the contrivance, similar to FIG. 4 but in a different functional position, applied to a hand tool.

The contrivance described may be the subject of some other use than that in which it is associated with a sewing machine. It could in fact be employed autonomously to thread a thread into a hand sewing needle. One such contrivance is shown in FIG. 11. In this drawing figure it can be seen that the tubular support 1 is affixed to a sleeve 26, while the rest of the contrivance is mounted as shown in FIG. 4, except that the belt 13 and the stirrup 22 are shown prior to the sliding of the tubular element 5 in the support 1 and of the cage 9 counter to the springs 7 and 15.

Among the other variants, not shown, it may also be noted that:

the restoring spring 7 may certainly be connected to the tubular element 5, rather than to the rod 6;

the slideway 19 could be kinematically solid with the slide 17 and the pin 17*a* of the belt 13, it being understood that the profile of this slideway must then have a shape that is symmetrical with that shown in the drawings; and the hook 18 can be replaced with any other appropriate grasping device. For instance, it could be a fork that would perform the threading by pushing the thread toward and through the eye.

What is claimed is:

1. A contrivance for passing a device for grasping a thread into the eye of a sewing needle affixed to a support, including a first movable means and first means solid with said support for guiding the first movable means, along a first path, a second movable means and second means, solid with said first movable means, for guiding said second movable means along a second path, stop devices limiting the displacement of each movable means on the respective path between a first and a second extreme position, first restoring means and second restoring means tending to maintain the first and second movable means in their first extreme position, said first and second restoring means, being such that the effort to move the first and second movable means away from said first extreme position is greater for the second movable means, means for driving said first and second movable means on their respective paths from the first extreme position to the second extreme position, against the action of said first and second restoring means, a third movable means carrying said grasping device and a ramp for guiding said third movable means along a third path, the ramp being solid with said first movable means and having a profile and an orientation such that, when the first movable means occupies the second extreme position, the path imposed by the ramp upon said grasping device passes through the eye of said needle, a kinematic linkage slaving said third movable means to said second movable means, wherein any displacement of said second movable means along said second path in a given direction corresponds to a similar displacement of said third movable means along said ramp, and wherein corresponding to the first and second extreme positions occupied by said second movable means on said second path are a first and a second limit position of said third movable means on said ramp such that, during the passage of said third movable means from the first to the second limit positions, said grasping device passes through the eye of said needle.

2. A contrivance as defined by claim 1, wherein said support comprises a first longitudinal and rectilinear element, of tubular structure over at least part of its length, having an inside lateral surface forming said first guide means, wherein said first movable means comprises a second longitudinal and rectilinear element of tubular structure over at least part of its length, having an inside lateral surface forming said second guide means, said second element sliding inside said first element, and wherein said second movable means comprises a third longitudinal and rectilinear element sliding inside said second element.

3. A contrivance as defined by claim 2, wherein said first longitudinal element is constituted by said needle support.

4. A contrivance as defined by claim 2, wherein said first restoring means comprises at least a first spring fixed between said first and third elements.

5. A contrivance as defined by claim 4, wherein said second restoring means comprises at least one second spring fixed between said second and third elements.

6. A contrivance as defined by claim 2, wherein said third ramp is rectilinear and extends transversely to said second element.

7. A contrivance as defined by claim 6, wherein said kinematic linkage includes a slideway, extending at least in part transversely to the sliding axis of said second element in said first element, and a pin, engaging the edges of the slideway, one of the slideway or pin, being at least kinematically solid with said second longitudinal element and the other being at least kinematically solid with said third longitudinal element.

8. A contrivance as defined by claim 7, wherein said slideway forms a closed loop.

9. A contrivance as defined by claim 8, wherein said closed loop includes four rectilinear segments, a first and a second of said segments extending parallel to the sliding axis of said second longitudinal element, the third and fourth segments each connecting two similar ends of said first and second segments and extending transversely to said second element.

10. A contrivance as defined by claim 9, wherein said first and second segments of said closed loop have an identical length.

11. A contrivance as defined by claim 9, wherein said grasping device includes at least one hook oriented toward the eye of said needle, and wherein the relative position of said slideway and said hook, and the distance between said first and second segments of the loop of said slideway are such that, when said second longitudinal element passes from one of said first and second extreme positions to the other, said hook passes through the eye of said needle, the limit positions of the hook on its path being fixed by the position of the first segment and the position of the second segment of said loop, respectively.

12. A contrivance as defined by claim 1, wherein said support is solid with a handle.

13. A sewing machine including a needle bar and a contrivance for passing a device for grasping a thread into the eye of a sewing needle affixed to a support kinematically solid with said needle bar, said contrivance including a first movable means and first means solid with said support for guiding the first movable means, along a first path, a second movable means and second means, solid with said first movable means, for guiding said second movable means along a second path, stop devices limiting the displacement of each movable means on the respective path between a first and a second extreme position, first restoring means and second restoring means tending to maintain the first and second movable means, respectively, in their first extreme position, said first and second restoring means being such that the effort to move the first and second movable means away from said first extreme position is greater for the second movable means, means for driving said first and second movable means, respectively, on their respective paths from the first extreme position to the second extreme position, against the action of said first and second restoring means, respectively, a third movable means carrying said grasping device and a ramp solid with said first movable means for guiding said third movable means along a third path, said ramp having a profile and an orientation such that, when the first movable means occupies the second extreme position, the path imposed by the ramp upon said grasping device passes through the eye of said needle, a kinematic linkage slaving said third movable means to the second movable means, wherein any displacement of said second movable means along said second path in a given direction corresponds to a similar displacement of said third movable means along said ramp, and wherein corresponding to the first and second extreme positions occupied by said second movable means on said second path are a first and a second limit position of said third movable means on said ramp such that, during the passage of said third movable means from the first to the second limit positions, said grasping device passes through the eye of said needle.

14. A sewing machine as defined by claim 13, wherein said support comprises a first longitudinal and rectilinear element, of tubular structure over at least part of its length, having an inside lateral surface forming said first guide means, wherein said first movable means comprises a second longitudinal and rectilinear element of tubular structure over at least part of its length, having an inside lateral surface forming said second guide means, said second element sliding inside said first element, and wherein said second movable means comprises a third longitudinal and rectilinear element, sliding inside said second element.

15. A sewing machine as defined by claim 14, wherein said first longitudinal element is formed by at least a portion of said needle bar of the machine.

16. A sewing machine as defined by claim 15, wherein said first restoring means comprises at least a first spring having first and second end, said spring being disposed inside said needle bar and being fixed to said needle bar, by the said first end, and to said third element, by the second end.

17. A sewing machine as defined by claim 16, wherein said second restoring means comprises at least a second spring having first and second ends fixed to said second and third elements, respectively.

18. A sewing machine as defined by claim 14, wherein said third ramp is rectilinear and extends transversely to said second elements.

19. A sewing machine as defined by claim 18, wherein said kinematic linkage includes a slideway extending at least in part transversely to said second element and a pin engaging the edges of the slideway, one of the slideway or pin, being at least kinematically solid with said second element and the other being at least kinematically solid with said third element.

20. A sewing machine as defined by claim 19, wherein said slideway forms a closed loop.

21. A sewing machine as defined by claim 20, wherein said closed loop includes four rectilinear segments, a first and a second of said segments extending parallel to the sliding axis of said second element inside said needle bar, the third and fourth segments each connecting two similar ends of said first and second segments and extending transversely to said sliding axis of said second element.

22. A sewing machine as defined by claim 21, wherein said first and second segments have an identical length.

23. A sewing machine as defined by claim 21, wherein said grasping device includes at least one hook oriented toward the eye of said needle, and wherein the relative position of said slideway and said hook, and the distance between said first and second segments of the loop of the slideway are such that, when said second longitudinal element passes from one of said first and second extreme positions to the other, said hook passes through the eye of said needle, the limit positions of the hook on its path being fixed, respectively, by the position of the first segment and the position of the second segment of said loop, respectively.

24. A sewing machine as defined by claim 15, wherein said third element carries a first and second thread support, extending on either side of the needle, respectively, and being oriented transversely to the longitudinal axis of the needle, wherein each of said first and second supports comprises means, for positioning the thread on a respective support.

25. A sewing machine as defined by claim 24, wherein said first and second thread supports are formed by a first and a second parallel arm, respectively, each having a shape of an open V, the bottom of the opening of said V of said first and second arms being substantially in alignment with said needle of the machine.

26. A sewing machine as defined by claim 25, wherein the position of said first and second supports on said third element is such that, when said third element reaches said second extreme position, said positioning means occupies a level lower than that of the path formed by said grasping device.

27. A sewing machine as defined by claim 13, wherein said means for driving said first and second movable means is carried by said third movable means.

28. A sewing machine as defined by claim 24, wherein said means for driving said first and second movable means includes said first and second thread supports.

* * * * *